US007520789B1

(12) United States Patent
Carlson

(10) Patent No.: US 7,520,789 B1
(45) Date of Patent: Apr. 21, 2009

(54) WATER INTAKE GRILL FOR PERSONAL WATERCRAFT

(76) Inventor: Morely Richard Carlson, 10313 Karston Ave., NE., Albertville, MN (US) 55301

( * ) Notice: Subject to any disclaimer, the term of this patent is extended or adjusted under 35 U.S.C. 154(b) by 0 days.

(21) Appl. No.: 11/906,603

(22) Filed: Oct. 2, 2007

(51) Int. Cl.
*B63H 11/01* (2006.01)

(52) U.S. Cl. ..... 440/46

(58) Field of Classification Search ..... 440/38, 440/46, 47, 88 M
See application file for complete search history.

(56) References Cited

U.S. PATENT DOCUMENTS

| | | | | | |
|---|---|---|---|---|---|
| 3,040,695 | A | * | 6/1962 | Austin | 440/46 |
| 3,147,733 | A | * | 9/1964 | Engel | 440/46 |
| 3,253,567 | A | * | 5/1966 | Patton, Jr. | 440/46 |
| 4,027,617 | A | * | 6/1977 | Ikeda et al. | 440/46 |
| 5,096,373 | A | * | 3/1992 | Struve et al. | 415/60 |
| 5,690,520 | A | * | 11/1997 | Rheault | 440/46 |
| 5,779,508 | A | * | 7/1998 | Pettesch et al. | 440/46 |

* cited by examiner

*Primary Examiner*—Stephen Avila

(74) *Attorney, Agent, or Firm*—Michael A. Mochinski; Lance Sanders

(57) ABSTRACT

A water intake grill for attachment to a water intake port of a jet watercraft. The water intake grill comprising a plurality of elongate members situated in between and mounted to fore and aft mounts. The fore mount comprising a base having an angularly orientated bottom surface for receiving and attaching first ends of the elongate members and an angularly orientated top surface for mounting atop thereof a singular key element having an overall geometric configuration substantially coinciding with the geometric configuration of a first inward socket integral to a forward wall section of the water intake port. The aft mount comprising a horizontally positioned base having rearward and forward sections, the rearward section having a primary key element in association with a cylindrical riser and the forward section having a secondary key element that extends across the width of the aft mount and includes an angular edge for receiving and attaching second ends of the elongate members. Each elongate member comprising a teardrop geometric profile incorporating an outward bottom section having a general rounded appearance and a tapered top end having sides commencing from an apex and extending angularly outward therefrom toward the outward bottom section, a geometric profile of which effectively reduces the amount debris into the water intake port while allowing continued passage of water into the water intake port to yield sustained operating performance of the jet watercraft and maintain effective cooling of the combustion engine generally associated therewith.

19 Claims, 11 Drawing Sheets

WATER INTAKE GRILL FOR PERSONAL WATERCRAFT

FIELD OF THE INVENTION

The present invention is directed to a water intake grill for attachment to a water intake port of a personal watercraft, namely a jet watercraft. More specifically the water intake grill effectively mitigates the entry of debris and foreign matter such as water grasses and moderately- to large-sized rock into the water intake port, sufficiently of which results in continued performance and a reduced occurrence of damage to the water jet propulsion system inherently included as part of the jet watercraft.

BACKGROUND OF THE INVENTION

The use of boats is a very popular recreational activity. The popularity of this recreational activity has led to a wide variety of boat designs, including by way of example, classic sailboats, boats specifically designed to improve the fishing experience, boats designed for speed and racing, and pontoon boats with a large flat deck designed to accommodate a number of individuals for socializing, eating, sunbathing, and swimming. Just as diverse as the number of boat designs is the number of options for propelling a boat through the water.

Sails capture the wind for propulsion and internal combustion engines turn one or more propellers to swiftly propel a boat through the water. Internal combustion engine configurations include outboard motors that are primarily attached to an exterior portion of a hull or transom of a boat with a propeller extending downwardly into the water for propulsion. Conversely, internal combustion engines are preferentially located within the confines of the boat where a shaft generally extends through the length of the boat's hull and exits through a watertight seal to permit connection to and rotate an external propeller to power the boat through the water. Placing an internal combustion engine inside a boat also lends to another form of boat design and propulsion possible: a jet boat that incorporates features of a water jet pump.

A jet boat is primarily propelled along the surface of a body of water such as a lake or ocean via a water jet propulsion system. Powerful motors draw in volumes of water from the lake or ocean and expel a stream of water from the stern of the boat with such extreme force that it swiftly propels the jet boat through the water. This water jet design in particular requires large volumes of water to be drawn into and expelled from a water jet. The powerful motors that are used in this configuration create a tremendous amount of suction to draw the large amounts of water into the system necessary to propel these boats at the desired operating speeds.

A jet boat of the type known in the art eliminates the presence of an external propeller, which offers a significant advantage to boaters. By reducing the risk of injury from a propeller, water jet propulsion has enabled greater human interaction with the boat and the water. This design element has made a number of smaller more unique boats possible, primarily those that can be operated by a lone operator. Many examples of these personal watercrafts exist as their popularity has expanded over past years.

For instance, personal watercraft manufacturers have adapted jet boat water jet propulsion technology into a unique boat design and application. Where a jet boat would accommodate one or typically two or more riders who enter and are seated in the jet boat, personal watercraft are smaller and more commonly designed for one operator to straddle the watercraft similar to a snowmobile or motorcycle. In another variation, the design of the Jet Ski®, as pioneered and trademarked by the Kawasaki Corporation of Japan, simulates water skiing by riders of these vehicles, primarily allowing one to stand and operate a steering handle while the water jet propels a single hull ski under the rider's feet. These unique applications of water jet technology are significant because they allow use of personal watercraft in areas where one would not typically expect to travel with a larger jet boat. This design coupled with its unique propulsion system has greatly expanded the use of personal watercraft for leisure recreational activity, water rescue activity, and for competitive sporting activities. Smaller bodies of water where boats are less common are now home to the smaller more versatile personal watercraft. Personal watercrafts because of their small size are easier to launch into shallow water than conventional boats. Personal watercrafts are typically lighter and have smaller trailers than larger-sized boats, such that it is possible for a lone user to launch a personal watercraft for a day of water recreation. Their unique propulsion system is free of externally mounted motors and propellers, thus making it easier to launch and use personal watercraft in smaller bodies of water and in shallow water. Smaller bodies of water and shallow areas do, however, present unique challenges to personal watercraft use and operation.

Smaller bodies of water and shallow areas are common places where one can find an accumulation of natural and manmade debris such as rocks, trash, dead fish, algae, and weeds. By the nature of both how the water jet propulsion system of personal watercraft operates and where users of personal watercraft choose to use these vehicles, personal watercraft are prone to problems with natural and manmade debris. The powerful motors of these vehicles have an inadvertent tendency to draw in water simultaneously with that of the debris that may consequentially harm the water jet propulsion system. Debris can enter the water inlet port of a water jet propulsion system and block or restrict the flow of water through the water jet. Any sufficient blockage of water flow can decrease performance of a water jet and may prevent it from functioning in a proper manner. Debris such as rocks can break or damage vital operable components of the water jet system which may necessitate expensive repairs. Some water jet systems are designed to use water to not only propel the watercraft, but also to divert a portion of that water stream to cool the internal combustion engine.

Internal combustion engines that are not properly cooled will accelerate the breakdown of lubricating oils and cause premature engine wear, ultimately of which may render the vehicle inoperable. In other instances, excessive debris in the water jet propulsion system could cause the engine to perform poorly and operate at higher revolutions per minute stressing the engine parts thereby greatly reducing the overall operational life of the personal watercraft.

There have been numerous attempts in the art to solve the aforementioned problems, including the attachment of a screen to the intake port that is adaptably designed to prevent the entry of debris and like matter into the jet propulsion system, notably of the type described in U.S. Pat. No. 3,040,695 entitled "Intake Strainer." However, the nature of screen construction in and of itself may act as an impediment to water flow into water jet pump. In fact, a poorly designed screen may disrupt the laminar water flow characteristics along the boat's hull. Furthermore, a screen of this type may further create turbulent, air-entrained water mixtures that when fed into the water inlet port of the water jet pump may appreciably decrease the efficiency of the jet watercraft. Screens also have the disadvantage of becoming unduly obstructed by the presence of debris that may be inadvertently held for some time onto the surficial portion of the screen, as principally established by the powerful suction of the jet water pump.

To address the problem of clogged screens, the prior art offers numerous examples of screens with mechanical cleaning components such as that depicted in U.S. Pat. No. 3,253,567 entitled "Mechanism for Use in Conjunction with the Intake Opening of a Water Jet Propelled Vehicle." These devices are extremely complex and the additional moving parts make them susceptible to higher requirements of service and maintenance and ultimately breakage. More modern personal watercrafts incorporate an intake guard configured with a pair of extended finned members connected to mounts that adaptably fit atop the water inlet port, generally being perceived to be less complex than the screen designs noted herein. Compared to such complex screen designs, the intake guard has a lower cost of manufacture and can be easily installed in new and existing jet watercraft. While the intake guard inherently offers these distinct design advantages, it may be ineffective as functioning as a barrier to water-borne debris, particularly moderately-sized rocks that can be semi-permanently trapped within the extended finned members, and protecting the water jet pump and associated operable components from damage.

Without attempting to modify the existing two bar screen design noted above, other attempts are documented in the art to address the nature of a clogged screen, including a manual cleaning device described in U.S. Pat. No. 5,690,520 entitled "Weed Removal Apparatus for a Jet Pump Propelled Watercraft." This sort of manual cleaning device presents several challenges, including the requirement of transporting and stowing the device during nonuse and awkwardness of using the device to fully appreciate its stated utility. In fact, novice personal watercraft users many not recognize the appropriate time to use such a manual device, particularly during times of jet watercraft operation.

In other attempts to solve this problem, especially in areas where vine-like water weeds are present and pose a common problem, the screen may be configured to allow one to open and reach into the water inlet chamber and water jet to manually remove weeds. This type of inlet screen with opening capabilities is described in U.S. Pat. No. 4,027,617 entitled "Grating Apparatus for Protecting the Draft Port of a Water Jet Propulsion System." This type of device is described as having a plurality of moving parts and springs that may have a tendency to prematurely wear and fail over a period of time. Another significant problem with the opening inlet screen is that it presumes weeds will enter the system and does little to prevent weeds from entering the system. Other attempts noted in the art to solve this problem have sought to block weeds from entering the water jet pump, such as the device described in U.S. Pat. No. 5,779,508, entitled "Anti-clogging Water Jet Craft," wherein extra appendages are attached to the bottom of the watercraft to block debris and like matter. This extra appendage, however, complicates the process of launching and trailering personal watercraft and reduces the desirable attribute of operating personal watercraft in shallow water.

Further attempts are noted in the art, including the alteration of the screen as described in U.S. Pat. No. 3,147,733 entitled "Inlet Screen," wherein the tines of the screen are attached to only one end of the screen. This design relies on the vibration of the engine and water flow under the boat's hull to cause the debris to remove itself from the inlet screen. This design lacks durability as the tines by design may unduly vibrate as a result of being attached to only one end. Also, this design does not solve the problem of solid compact debris, notably large rocks, which can enter the end of the screen where the tines are not attached.

Accordingly, there remains a need for a jet watercraft intake grill comprising solid, single piece construction, particularly of which prevents water-borne debris from entering into the water jet pump, functions without rider intervention, provides for an improved condition of laminar water flow into the water intake port of the water jet pump, permits continued operation of the jet watercraft in shallow water without undue obtrusiveness, and furthers the ease of loading and unloading the personal watercraft into a body of water.

BRIEF SUMMARY OF THE INVENTION

In order to overcome the numerous drawbacks apparent in the prior art a water intake grill has been devised for adaptation and use with a jet watercraft of the type commonly known and available in the art to carry and transport one or more persons over a surface of a body of water.

It is an object of the present invention to provide a water intake grill that is sufficiently capable of mitigating the entry of water-borne debris such as suspended weeds and moderately- to large-sized rocks into a water jet inlet port of a jet watercraft.

It is another object of the present invention to provide a water intake grill that is easily manufactured as a solid, single piece to yield reliable, durable performance and lessen the overall cost of manufacture.

It is another object of the present invention to provide a water intake grill that effectively reduces costly repairs and operational downtime generally associated with a jet watercraft's factory-installed intake guard.

It is another object of the present invention to provide a water intake grill that improves the laminar water flow characteristics through the water jet inlet port and into the water jet pump of the jet watercraft to sustain its performance as configured and designed by the manufacturer.

It is another object of the present invention to provide a water intake grill that moderately improves fuel efficiency of a jet watercraft by means of sustaining adequate water flow into and through the water jet propulsion system.

It is yet another object of the present invention to provide a water intake grill which accomplishes the foregoing and other objects and advantages and which is economical, durable, and fully effective in performing its intended functions without unduly compromising the performance of the jet watercraft.

In accordance with the present invention, a water intake grill has been devised for easy installation and replacement of a factory-installed intake guard commonly associated with a water intake port of a stock jet watercraft, the water intake grill preferentially comprising a plurality of elongate member situated in between and attached to fore and aft mounts, the fore mount having a base with angularly orientated top and bottom surfaces and a singular key element extending upward from and connected to the angularly orientated top surface, the singular key element comprising pitched sides having upper leading edges terminating at and connected to the periphery of a top end to form an overall geometric configuration substantially coinciding with the geometric configuration of a first inward socket integral to a forward wall section of the water intake port, the aft mount comprising a horizontally positioned base having rearward and forward sections, the rearward section having a cylindrical riser integrally associated with a primary key element having walls extending vertically upward from a top planar surface of the horizontally positioned base and terminating at and connected to a peripheral edge of a top face end, the forward section comprising a secondary key element that extends across the width of the aft mount and includes an angular edge for receiving and attaching second ends of the elongate members and an elevated back edge integrally connected thereto and positioned parallel to the angular edge, each elongate member comprising a teardrop geometric profile incorporating an outward bottom section having a general rounded appearance and a tapered top end having sides commencing from an apex and extending angularly outward toward the outward bottom section, a geometric profile of which effectively reduces the amount of debris into the water intake port while allowing continued passage of water into the water intake port to yield sustained operating performance of the jet watercraft and maintain effective cooling of the combustion engine generally associated with the jet watercraft.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE PREFERRED EMBODIMENT

While this invention is susceptible of being embodied in many different forms, the preferred embodiment of the invention is illustrated in the accompanying drawings and described in detail hereinafter with the understanding that the present disclosure is considered to exemplify the principles of the present invention and is not intended to unduly limit the invention to the embodiments illustrated and presented herein. The present invention has particular utility as a device for minimizing the passage of debris and foreign matter of the type commonly resting on the bottom of and/or suspended in a body of water into a water intake port of a jet watercraft while simultaneously permitting the continuous passage of water into and through the water intake port of the jet watercraft to promote its effective operation as configured and designed by the manufacturer.

Figure 1:
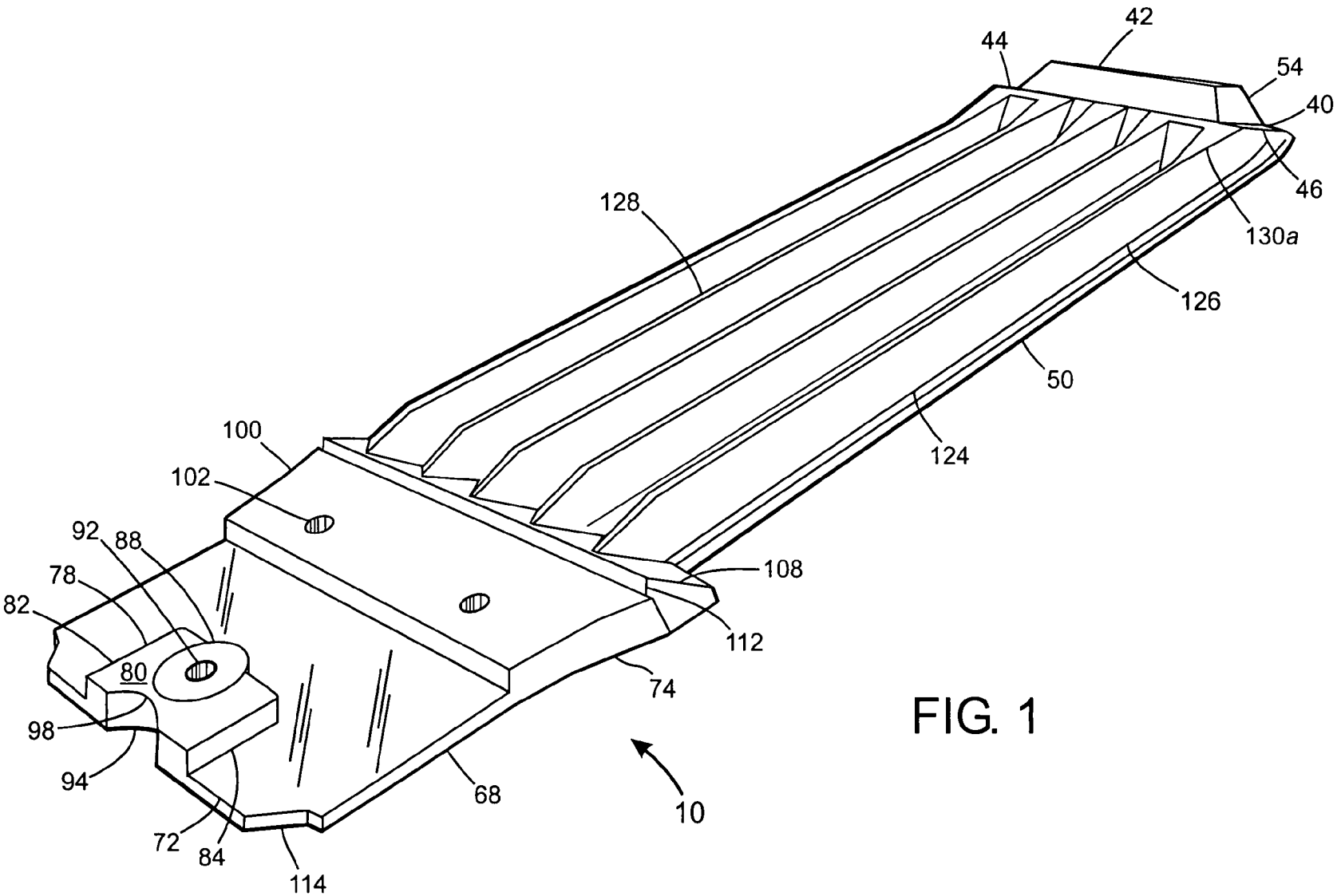
FIG. 1 is a perspective view of the preferred embodiment of the present invention illustrating a plurality of elongate members situated in between and connected to fore and aft mounts.
Figure 2:
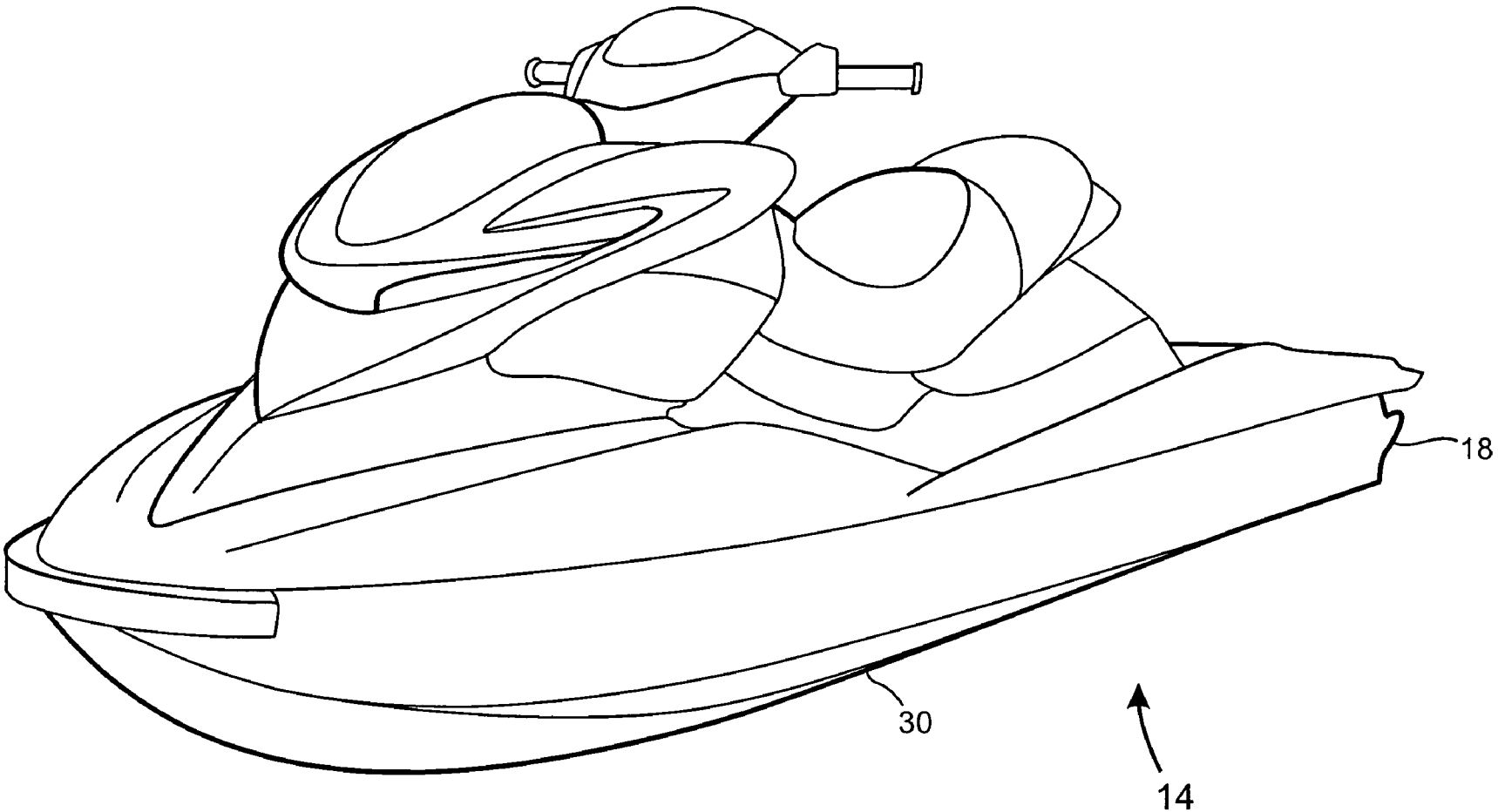
FIG. 2 is a perspective view of a jet watercraft of the type known and available in the art to carry and transport one or more persons over a surface of a body of water.
Figure 3:
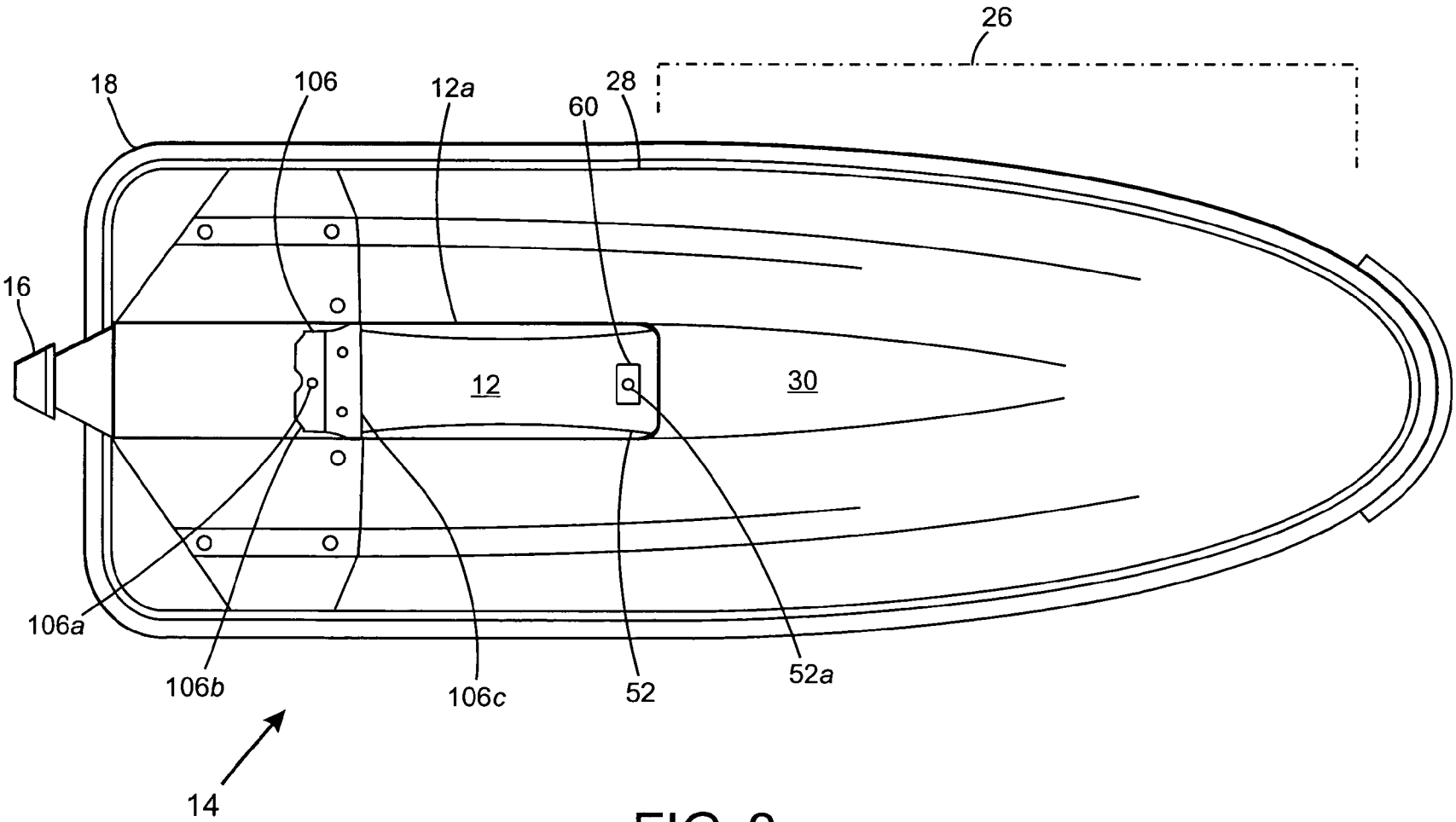
FIG. 3 is a bottom plan view of a hull of a jet watercraft having a water intake port for receiving water and a constriction nozzle located at rear side of the jet watercraft for forcibly propelling water outwardly therefrom.

Reference is now made to FIG. 1 of the drawings illustrating a water intake grill 10 for attachment to a water intake port 12 of a jet watercraft 14 of the type commonly known in the art to carry and transport one or more persons over a surface of a body of water. The jet watercraft, as depicted in FIGS. 2 and 3, generally includes means for drawing into the water intake port a predetermined volume of water and expelling the water forcibly outward from a constricting nozzle 16 located at a rear side 18 of the jet watercraft 14. In most jet watercraft configurations, notably of the type shown in FIG. 4, water drawing means typically comprises a mixed flow impeller 20 housed within a centralized casing 22 in hydraulic communication with the water intake port and constricting nozzle 16 and connected to a drive shaft 24 which is rotatably driven by an internal combustion engine (not shown) located near a front-to-mid sectional portion 26 of the jet watercraft, as shown by the bounded line in FIG. 3. The intake of water into and through the water intake port 12 may supplement cooling of the internal combustion engine via a plurality of open duct ways (not shown) in hydraulic communication with the centralized casing and internally housed and routed within an engine compartment of the jet watercraft 14 and/or solely within the configuration of the combustion engine. Other and more modern jet watercraft configurations may eliminate the open duct ways entirely and rely on most part on a closed cooling system (not shown) to eliminate any introduction of debris and like matter that may hamper effective cooling of the combustion engine. It is noted herein that the water intake grill 10 of the present invention is primarily directed and suited to both configurations described above, specifically being configured in the former to minimize the passing of debris and like foreign matter into the water intake port 12 and open duct ways that may rise to compromised performance or entire breakdown of the jet watercraft 14 due to inadequate cooling of the combustion engine and in the later and former to mitigate the passing of moderately-sized rocks through the water intake port and into the centralized casing 22 that may inadvertently strike and damage the mixed flow impeller 20 and associated operable components like the drive shaft 24 residing therewithin.

Figure 5:
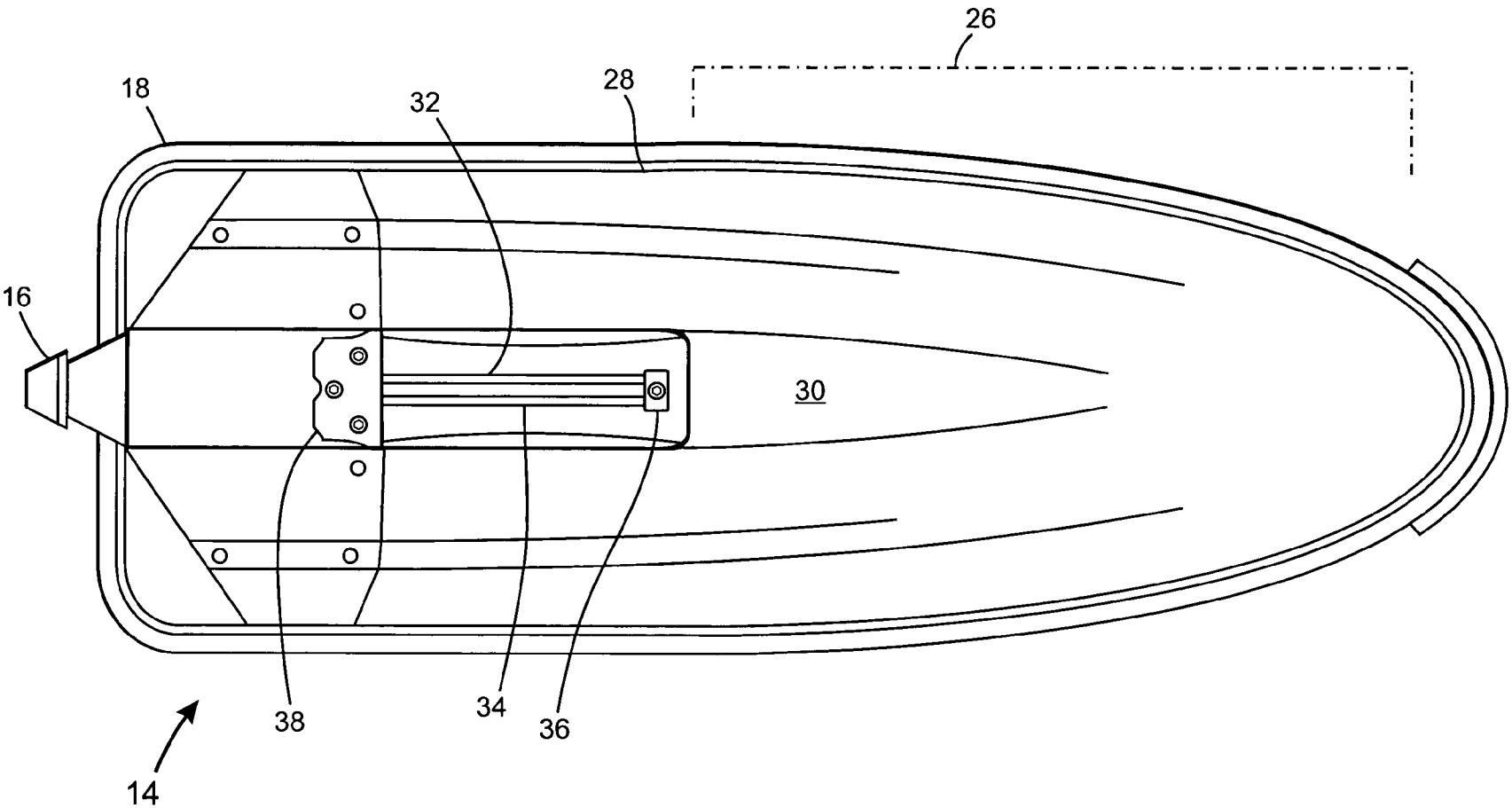
FIG. 5 (PRIOR ART)
FIG. 5 is a bottom plan view of a hull of a stock jet watercraft equipped with an intake guard of the type typically known in the art and mounted to a water intake port of the jet watercraft.
Figure 6:
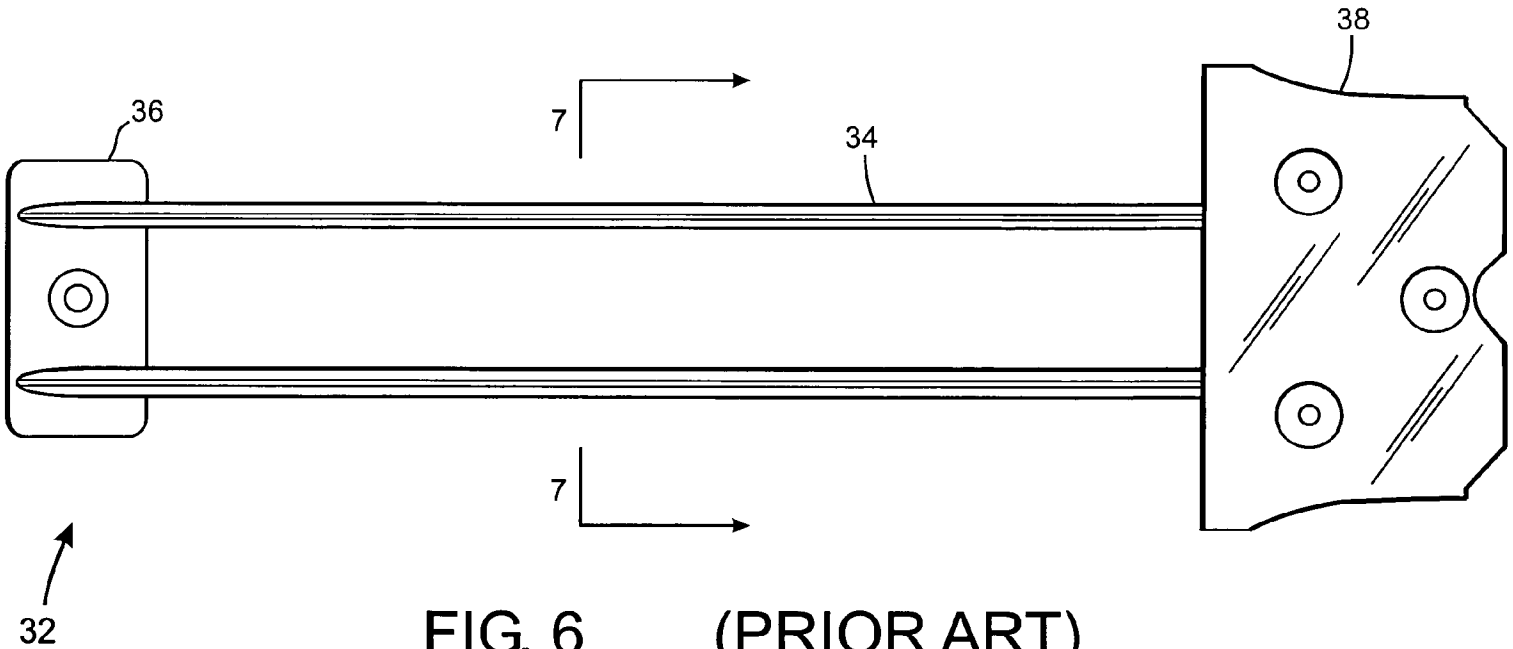
FIG. 6 (PRIOR ART)
FIG. 6 is a bottom plan view of an intake guard of the type known in the art and configured for attachment to a water intake port of a stock jet watercraft.
Figure 7:
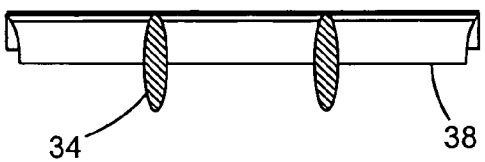
FIG. 7 (PRIOR ART)
FIG. 7 is a cross sectional view of an intake guard taken along line 7-7 in FIG. 6 illustrating a pair of extended finned members.

As illustrated in FIGS. 3 and 5, the water intake port 12 present in a stock jet watercraft is typically located about an underside portion 28 of a jet watercraft's hull 30, approximately one-third distance from the rear side 18 of the jet watercraft. In stock jet watercraft configurations, the water intake port is preferentially fitted with a factory-installed intake guard 32, typically shown in FIGS. 6 and 7 to comprise a pair of extended finned members 34 situated in between and having ends connected to fore and aft stock mounts 36, 38. The fore and aft stock mounts of the type configured for jet watercraft 14 in particular may include a number of design configurations to further adapt to the unique design characteristics and structural features of the water intake port incorporated and inherently included in many of today's jet watercraft, such as those manufactured and made available by Kawasaki Corporation and Suzuki Corporation, both of Japan.

Figure 4:
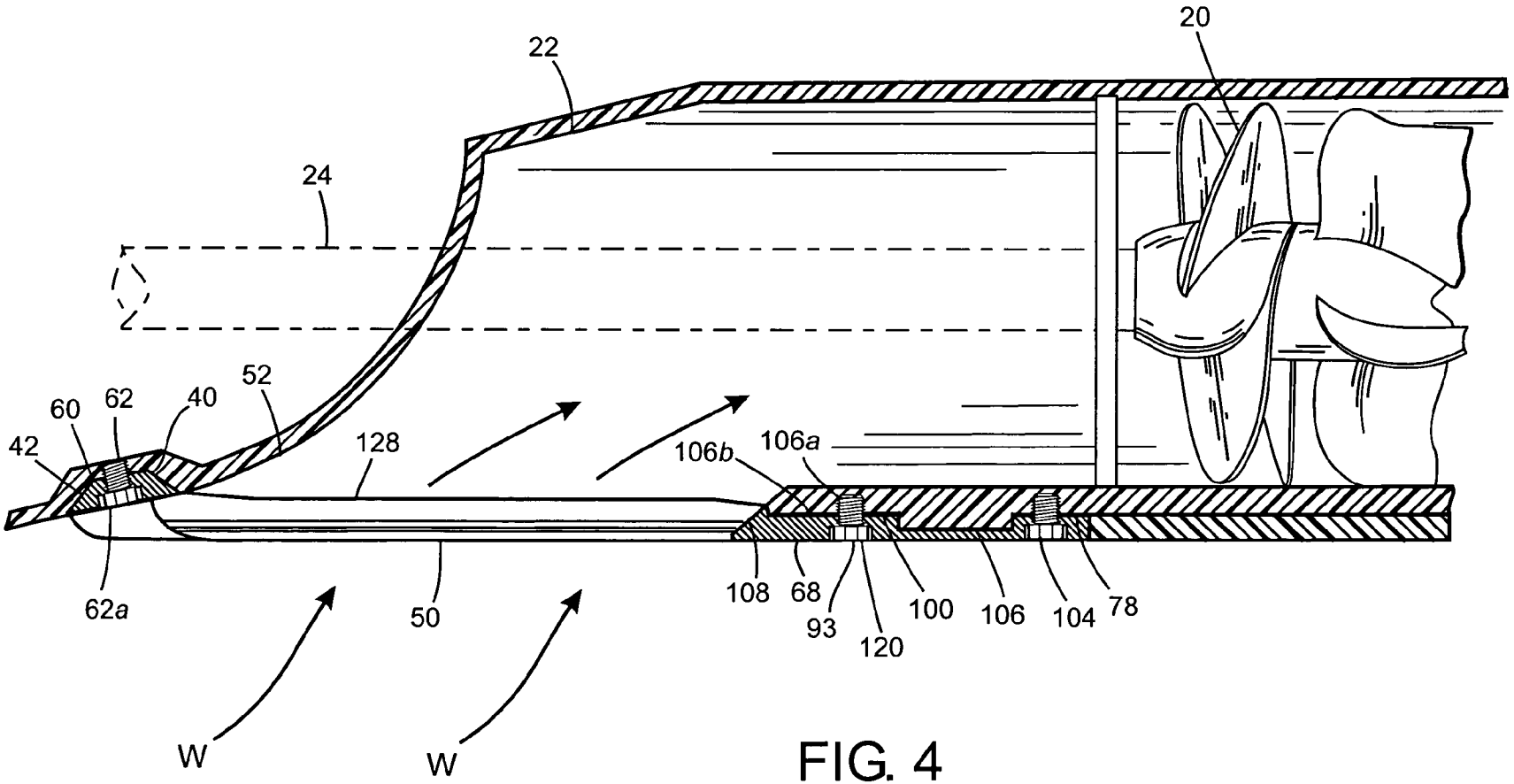
FIG. 4 is a partial cross sectional view of a water intake port of a stock jet watercraft equipped with a water intake grill of the present invention and a mixed flow impeller of the type associated with the jet watercraft.
Figure 8:
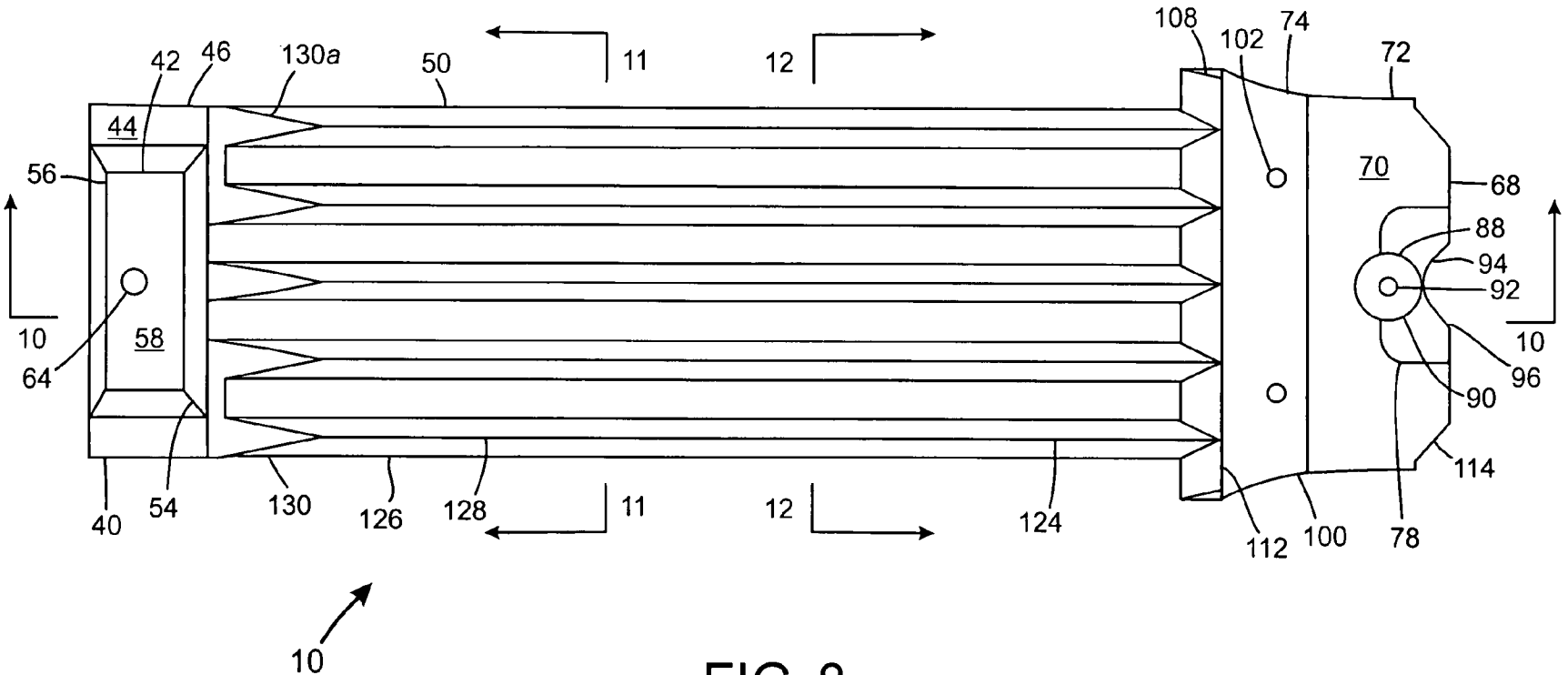
FIG. 8 is a top plan view of the preferred embodiment of the present invention illustrating a plurality of elongate members situated in between and connected to fore and aft mounts.
Figure 9:
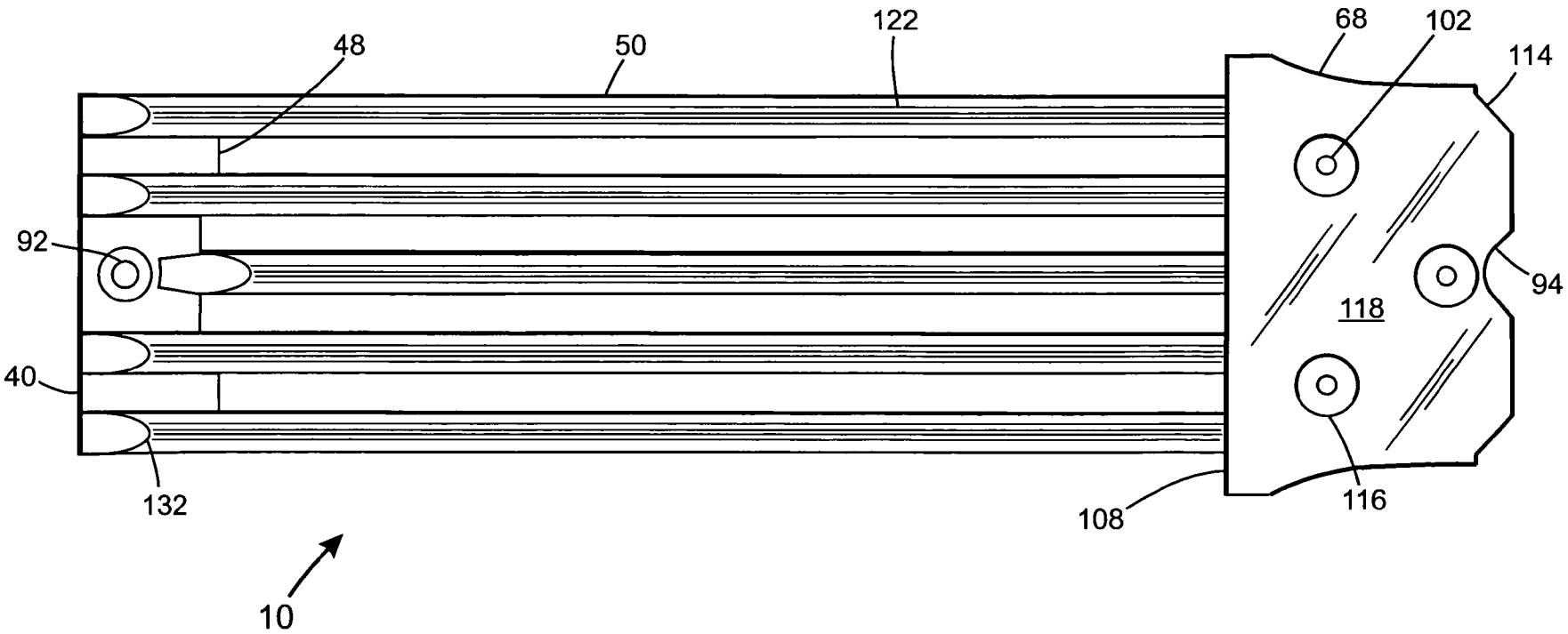
FIG. 9 is a bottom plan view of the preferred embodiment of the present invention illustrating a plurality of elongate members situated in between and connected to fore and aft mounts.

A fore mount 40 of the present invention, as illustration in FIG. 8, incorporates a singular key element 42 emanating upwardly from a base 44 having angularly orientated top and bottom surfaces 46, 48 in relation to a plurality of elongate members 50, preferentially coinciding with the positional or angular orientation of a forward wall section 52 of the water intake port 12 shown in FIG. 4. The singular key element preferably comprises pitched sides 54 having upper leading edges 56 terminating at and connected to the periphery of a top end 58 to form an overall geometric configuration substantially coinciding with the geometric configuration of a first inward socket 60 integral to the forward wall section 52 of the water intake port. The placement of the singular key element 42 within the geometric confines of the first inward socket further ensures correct orientation of the fore mount 40 and consequentially the water intake grill 10 within the structural configuration of the water intake port 12. A mount bolt 62 or an equivalent type of fastener positioned within a centralized aperture 64 extending through the singular key element and base 44 and threadably attached at its end to a threaded aperture 52*a* integral to the forward wall section 52 sufficiently serves in part to mount the water intake grill 10 to the water intake port. The centralized aperture as shown in FIG. 9 is generally associated with a circular recess 66 inwardly extending into the singular key element 42 from the angularly orientated bottom surface 48 of the base to conceal a head portion 62*a* of the mount bolt to further streamline the appearance of and permit unobstructive water flow over and around the water intake grill 10 while attached to the jet watercraft.

Referring now to FIG. 8, an aft mount 68 of the present invention preferably comprises a horizontally positioned base 70 having rearward and forward sections 72, 74 each sufficing as a location to properly orientate the aft mount relative to and fixedly secure its position to the water intake port 12 by anchoring means, preferentially comprising an arrangement of mount bolts or an equivalent type of fastener. The rearward section 72 in particular is shown in FIG. 8 with a primary key element 78 having a top face end 80 incorporating a peripheral edge 82 and walls 84 extending vertically upward from a top planar surface 86 of the horizontally positioned base and terminating at and connected to the peripheral edge. A cylindrical riser 88 integrally associated with the primary key element 78 and having a top end 90 substantially positioned above the top face end a predetermined distance is further shown in FIG. 10. An aperture 92 extending longitudinally through the cylindrical riser 88 and passing through the horizontally positioned base 70 receives a mount bolt 93 or an equivalent type of fastener. The primary key element 78 is further illustrated in FIG. 8 to comprise an integrally formed semi-circular notch 94 that intersects a mid-portion 96 of the wall of the primary key element; an inward portion 98 of the semi-circular notch is generally shown as being positioned across from and in proximity to the cylindrical riser 88.

Figure 10:
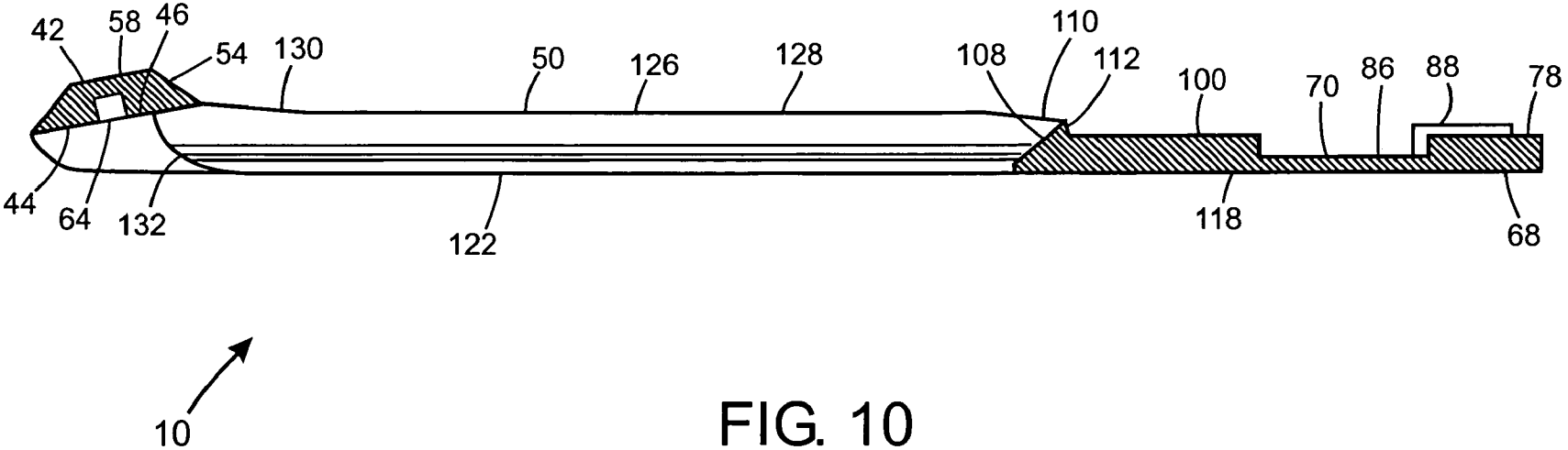
FIG. 10 is a cross sectional view of the preferred embodiment of the present invention taken along line 10-10 in FIG. 8 illustrating a singular key element integrally connected to a fore mount and primary and secondary key elements integrally connected to an aft mount.

Referring now to FIG. 8 the forward section 74 is shown to comprise a secondary key element 100 that extends substantially across the width of the aft mount and occupies approximately one-third to one-half of the surficial area of the horizontally positioned base 70. The secondary key element is preferentially shown to have an equivalent height to that of the primary key element 78, but further includes a pair of apertures 102 extending therethrough, generally being positioned in an offsetting manner to the aperture 92 provided for the primary key element. Like the primary key element, mount bolts 104 or equivalent fastener types supplementally serve to secure a portion of the aft mount 68 to the water intake port 12 by means of their insertion into the pair of apertures 102 and threaded attachment at each of their ends to threaded apertures 106*a* present in a rearward wall section 106 of the water intake port. As depicted in FIG. 10, the secondary key element 100 is further associated with an angular edge 108 for receiving and attaching second ends 110 of the elongate members 50 and an elevated back edge 112 integrally connected thereto and positioned parallel to the angular edge. The resultant configuration of the elevated back edge along with primary and secondary key elements sufficiently define a unified structure that preferentially conforms to second and third inward sockets 106*b*, 106*c*, respectively, of the rearward wall section of the water intake port 12 to further ensure the proper positioning of the water intake grill 10. Angular notched corners 114 may supplement the lateral fitting of the aft mount 68 to the water intake port, specifically of the form depicted in FIG. 9. Like the singular key element 42, each aperture of the primary and secondary key elements is generally associated with a circular recess 116 inwardly extending into the key elements from an outward back surface 118 of the horizontally positioned base to conceal a head portion 120 of the mount bolt, purposefully to facilitate a streamlined appearance of and permit unobstructed water flow over and around the water intake grill 10 while it is mounted to the water intake port 12. It is worthy to note that the aft and fore mounts described above and elsewhere may eliminate or comprise one or more key elements which sufficiently serve to correctly position and tighteningly secure the water intake grill to the water intake port. The number and configuration of each of the key elements present in any one, overall configuration of the water intake grill largely depends on the manufacturer's layout and inward socket configuration of the water intake port. For this reason, the aft and fore mounts integrated into the water intake grill 10 of the present invention is not limited to the specific embodiment described herein; other key element configurations or none at all may be further contemplated herein.

Figure 11:
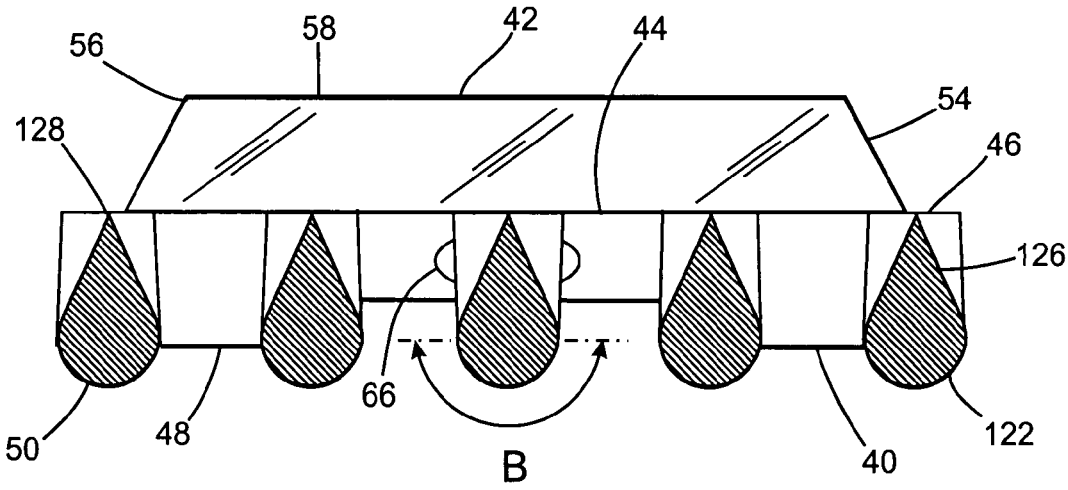
FIG. 11 is a cross sectional view of the preferred embodiment of the present invention taken along line 11-11 in FIG. 8 illustrating a plurality of elongate members and a singular key element integrally connected to a fore mount.
Figure 12:
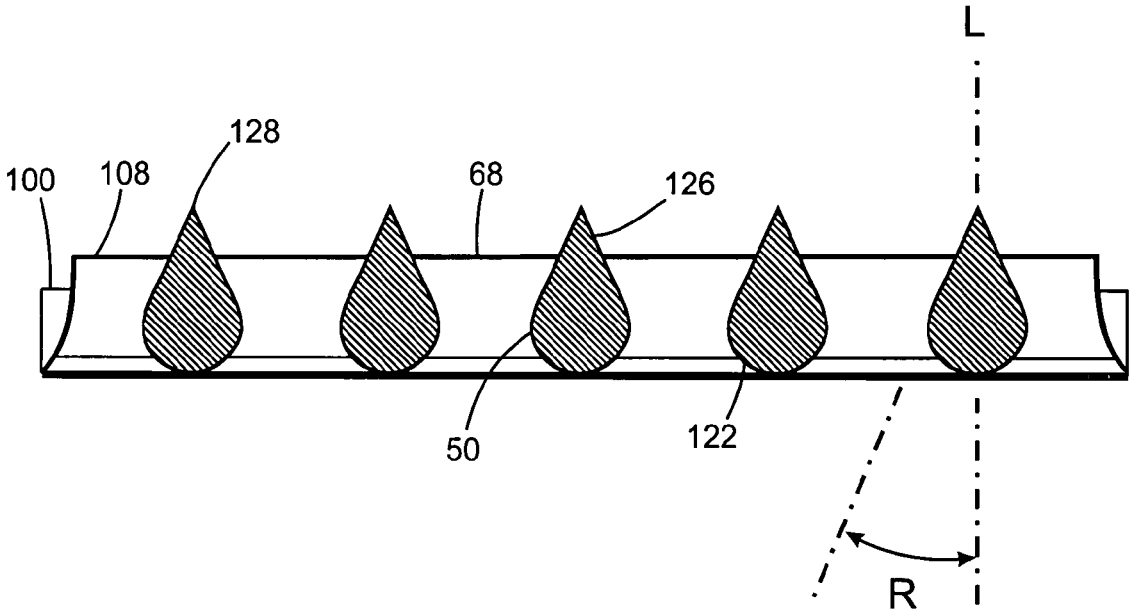
FIG. 12 is a cross sectional view of the preferred embodiment of the present invention taken along line 12-12 in FIG. 8 illustrating a plurality of elongate members integrally connected to an angular edge of an aft mount.
Figure 13:
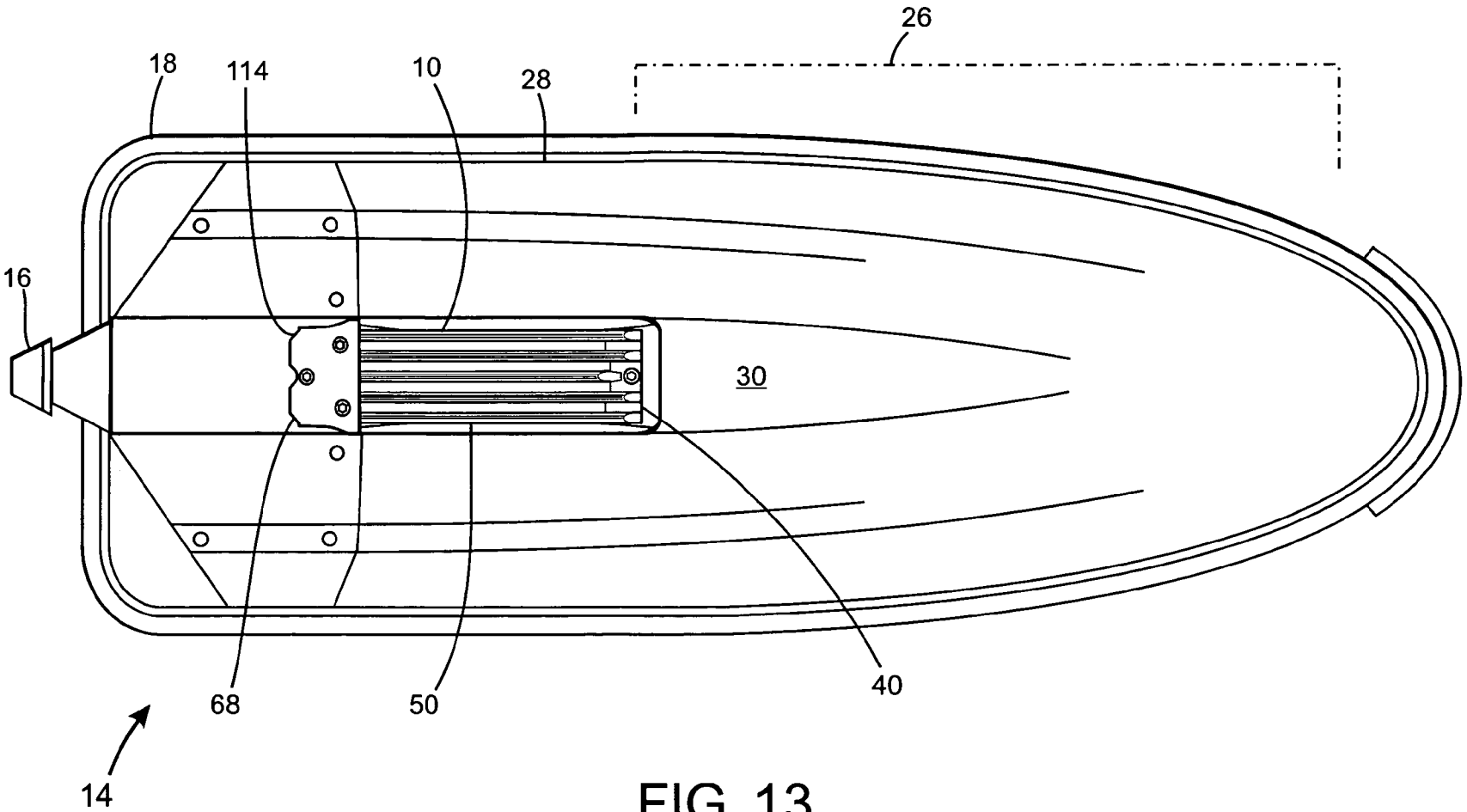
FIG. 13 is a bottom plan view of a hull of a stock jet watercraft equipped with a water intake grill of the present invention, specifically being mounted over a water intake port of the jet watercraft.

Referring now to FIGS. 11 and 12, each elongate member 50 of the water intake grill comprises a teardrop geometric profile or a profile resembling an airfoil of an airplane's wing to permit or promote a condition of laminar water flow over the set of elongate members 50 while restricting the passage of most debris and foreign matter that may hamper engine performance of the jet watercraft 14, as previously discussed elsewhere herein. A plurality of lines designated as W in FIG. 4 indicates the direction of water flow to establish this preferred laminar condition. A cross sectional view of the elongate member, as depicted in FIG. 11, reveals an outward bottom section 122 having a general rounded appearance, a configuration of which primarily functions to shed away debris and lessen the accumulation of debris at the water intake port 12 insofar to permit continued passage of water into the water intake port for sustained engine performance. Arc B in FIG. 11 defines the extent for which the outward bottom section 122 of the elongate member is considered as having a preferred rounded appearance. As illustrated in FIG. 12 each elongate member 50 is further associated with a tapered top end 124 having sides 126 commencing from an apex 128 and extending angularly outward toward the outward bottom section. In the preferred embodiment of the water intake grill 10, an angular orientation R of 25 degrees establishes the angular extent to which the sides 126 are positioned relative to axis L shown in FIG. 12. A minimum intake opening of at least ⅜ inch, as shown in FIG. 13, is held in between each of the elongate members 50 and adjacent sidewalls 12*a* of the water intake port 12, preferentially of which establishes a reduction of passing debris into the water intake port while permitting a sufficient water flow through the water intake grill 10 and into the water intake port to yield sustained cooling of the combustion engine and maintain efficient performance of the propulsion system of the jet watercraft.

Further shown in FIG. 8, a first end 130 of the elongate member preferably comprises a splayed outward portion 130*a* to strengthen and enhance the structural integrity of the connection in between the elongate member 50 and angularly orientated bottom surface 48 of the fore mount's base. An integral elbow 132 of the type illustrated in FIG. 10 is generally associated with the first end of each elongate member to further streamline the appearance of the set of elongate members 50 while attached to the fore mount 40 and provide for a condition of laminar water flow over the water intake grill 10 and the boat's hull 30 during operation of the jet watercraft 14 in a body of water.

It can be seen from the foregoing that there is provided in accordance with this invention a simple and easily operated device, which is particularly suited for attachment to a water intake port 12 of a jet watercraft 14 of the type noted in the art to carry and transport one or more persons over a surface of a body of water. Prolonged testing of the water intake grill 10 reveals improved performance of the jet watercraft over the intake guard 32 in stock arrangements, primarily due to its effectiveness in shedding away and mitigating entry of waterborne debris such as suspended weeds and moderately- to large-sized rocks into the water intake port of the jet watercraft. Through the reduction and even elimination of such debris from the water intake port, sustained cooling of the combustion engine and reduced damage to the mixed flow impeller 20 and associated operable components are appreciably apparent to the extent of permitting relied operation and performance of the jet watercraft as configured and designed by the manufacturer.

It is obvious that the components comprising the water intake grill may be fabricated from a variety of materials, providing such selection or use of materials possess the capacity to withstand forces acting thereon throughout its duration of use on a jet watercraft. Accordingly, it is most desirable, and therefore preferred, to construct the water intake grill 10 from steel coated with a polymeric or epoxy paint or equivalent, stainless steel, aluminum or an equivalent type of material capable of preventing premature corrosion of the substrate while in the presence of a fresh or salt water environment. To lessen the cost and simplify construction of the water intake grill and increase its overall structural integrity, the fore and aft mounts 40, 68 as well as the set of elongate members 50 are preferably fabricated as a unified structure, typically by means of cast molding or an equivalent form of technology.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A water intake grill for attachment to a water intake port having a pair of sidewalls and forward and rearward wall sections each having at least one inward socket, said intake grill comprising, in combination:

a fore mount having a base with angularly orientated top and bottom surfaces substantially coinciding with the positional orientation of the forward wall section;

an aft mount having a horizontally positioned base with a top planar surface and rearward and forward sections substantially coinciding with the positional orientation of the rearward wall section;

means for anchoring said fore and aft mounts to the forward and rearward wall sections of water intake port, respectively; and a plurality of elongate members each having first and second ends and a teardrop geometric profile incorporating a tapered top end and an outward bottom section having a general rounded appearance, said first end of elongate member being integrally connected to said angularly orientated bottom surface of base and having a splayed outward portion to strengthen the connection thereat and an integral elbow to minimize its obstructiveness, said second end of elongate member being integrally connected to said forward section of aft mount.

2. An intake grill as set forth in claim 1, wherein said fore and aft mounts each comprise at least one key element geometrically configured to fit within an equal number of inward sockets of forward and rearward wall sections, respectively, said key elements each comprising at least one aperture extending therethrough to receive said anchoring means.

3. An intake grill as set forth in claim 2, wherein said anchoring means comprises mount bolts passing through said apertures of key elements of fore and aft mounts and having ends extending into threaded apertures integrally included in the forward and rearward wall sections of water intake port.

4. An intake grill as set forth in claim 2, wherein said key element of fore mount comprises a top end having upper leading edges and pitched sides extending from said angularly orientated top surface of base and terminating at said upper leading edges.

5. An intake grill as set forth in claim 2, wherein said key element of aft mount comprises a top face end having a peripheral edge and walls extending from said top planar surface of horizontally positioned base and terminating at said peripheral edge.

6. An intake grill as set forth in claim 5, wherein said key element of aft mount comprises a cylindrical riser having a top end substantially positioned above said top face end a predetermined distance, said aperture of aft mount extending longitudinally through said cylindrical riser and passing through said horizontally positioned base for receiving therein said anchoring means.

7. An intake grill as set forth in claim 5, wherein said key element of aft mount comprises an integrally formed semicircular notch intersecting said wall of key element of aft mount and extending downwardly and passing through said horizontally positioned base of aft mount.

8. An intake grill as set forth in claim 1, wherein said rearward and forward sections of aft mount comprise primary and secondary key elements, respectively, mounted to and extending upwardly from said top planar surface of horizontally positioned base, said primary key element comprising a top face end having a peripheral edge and walls extending from said horizontally positioned base and terminating at said peripheral edge and a cylindrical riser with an aperture extending longitudinally therethrough for receiving therein said anchoring means, said secondary key element comprising an angular edge for receiving and attaching said second ends of elongate members and an elevated back edge integrally connected thereto and positioned parallel to said angular edge and a pair of apertures extending therethrough in an offsetting manner to said aperture of cylindrical riser for receiving therein said anchoring means.

9. An intake grill as set forth in claim 1, wherein said forward section of aft mount comprises a pair angular notched corners.

10. An intake grill as set forth in claim 1, wherein said tapered top end of elongate member comprises an apex and a pair of sides each commencing from said apex and extending angularly outward 25 degrees from a longitudinal axis extending through said apex and said outward bottom section.

11. An intake grill as set forth in claim 1, wherein said elongate members are held apart from one another and sidewalls of water intake port to form a minimum intake opening of at least ⅜ inch.

12. A water intake grill for attachment to a water intake port having a pair of sidewalls, a forward wall section having a first inward socket, and a rearward wall section having second and third inward sockets, said intake grill comprising, in combination:

a fore mount having a singular key element geometrically configured to fit within the first inward socket of forward wall section and a base having angularly orientated top and bottom surfaces substantially coinciding with the positional orientation of the forward wall section, said singular key element comprising a centralized aperture having a circular recess for receiving and accepting therein a mount bolt to tighteningly secure said fore mount to the forward wall section;

an aft mount having a horizontally positioned base substantially coinciding with the positional orientation of the rearward wall section and primary and secondary key elements each being geometrically configured to fit within the second and third inward sockets of rearward wall section, respectively, said primary key element comprising a cylindrical riser and an aperture extending longitudinally therethrough for receiving therein a mount bolt, said secondary key element comprising a pair of apertures extending therethrough in an offsetting manner to said aperture of cylindrical riser for receiving therein mount bolts to supplementally secure said aft mount to the rearward wall section of water intake port and an angular edge and an elevated back edge integrally connected thereto and positioned parallel to said angular edge; and a plurality of elongate members each having first and second ends and a teardrop geometric profile incorporating a tapered top end and an outward bottom section having a general rounded appearance, said first end being integrally connected to said angularly orientated bottom surface of base and said second end being integrally connected to said angular edge of secondary key element.

13. An intake grill as set forth in claim 12, wherein said singular key element comprises a top end having upper leading edges and pitched sides extending from said angularly orientated top surface of base and terminating at said upper leading edges and said primary key element comprises a top face end having a peripheral edge and walls extending from said horizontally positioned base and terminating at said peripheral edge.

14. An intake grill as set forth in claim 12, wherein said elongate members are held apart from one another and sidewalls of water intake port to form a minimum intake opening of at least ⅜ inch and said tapered top end of elongate member comprises an apex and a pair of sides each commencing from said apex and extending angularly outward 25 degrees from a longitudinal axis extending through said apex and said outward bottom section.

15. A water intake grill for attachment to a water intake port having a pair of sidewalls, a forward wall section having a first inward socket, and a rearward wall section having second and third inward sockets, said intake grill comprising, in combination:

a fore mount having a singular key element geometrically configured to fit within the first inward socket of forward wall section and a base having angularly orientated top and bottom surfaces substantially coinciding with the positional orientation of the forward wall section, said singular key element comprising a top end having upper leading edges and pitched sides extending from said angularly orientated top surface of base and terminating at said upper leading edges and a centralized aperture having a circular recess accessible from said angularly orientated bottom surface for receiving and accepting therein a mount bolt to tighteningly secure said fore mount to the forward wall section;

an aft mount having a horizontally positioned base substantially coinciding with the positional orientation of the rearward wall section and primary and secondary key elements each being geometrically configured to fit within the second and third inward sockets of rearward wall section, respectively, said primary key element comprising a top face end having a peripheral edge and walls extending from said horizontally positioned base and terminating at said peripheral edge, said primary key element further comprising a cylindrical riser and an aperture extending longitudinally therethrough for receiving therein a mount bolt, said secondary key element comprising a pair of apertures extending therethrough in an offsetting manner to said aperture of cylindrical riser for receiving therein mount bolts to supplementally secure said aft mount to the rearward wall section of water intake port and an angular edge and an elevated back edge integrally connected thereto and positioned parallel to said angular edge; and a plurality of elongate members each having first and second ends and a teardrop geometric profile incorporating a tapered top end and an outward bottom section having a general rounded appearance, said first end being integrally connected to said angularly orientated bottom surface of base and said second end being integrally connected to said angular edge of secondary key element.

16. An intake grill as set forth in claim 15, wherein said elongate members are held apart from one another and sidewalls of water intake port to form a minimum intake opening of at least ⅜ inch.

17. An intake grill as set forth in claim 15, wherein said tapered top end of elongate member comprises an apex and a pair of sides each commencing from said apex and extending angularly outward 25 degrees from a longitudinal axis extending through said apex and said outward bottom section.

18. An intake grill as set forth in claim 15, wherein said primary key element comprises an integrally formed semi-circular notch intersecting said wall of primary key element and extending downwardly and passing through said horizontally positioned base.

19. An intake grill as set forth in claim 15, wherein said first end of elongate member comprises a splayed outward portion to strengthen the connection at said angularly orientated bottom surface and an integral elbow to minimize the obstructiveness of said elongate member.

* * * * *